US009022015B2

(12) United States Patent
Tseng

(10) Patent No.: US 9,022,015 B2
(45) Date of Patent: May 5, 2015

(54) AIR GUN MAGAZINE WITH RATCHET LOADING MECHANISM

(71) Applicant: Jui-Fu Tseng, Yilan (TW)

(72) Inventor: Jui-Fu Tseng, Yilan (TW)

( * ) Notice: Subject to any disclaimer, the term of this patent is extended or adjusted under 35 U.S.C. 154(b) by 15 days.

(21) Appl. No.: 14/017,307

(22) Filed: Sep. 4, 2013

(65) Prior Publication Data

US 2015/0059723 A1 Mar. 5, 2015

(51) Int. Cl.

| | |
|---|---|
| ***F41B 11/00*** | (2013.01) |
| ***F41A 9/00*** | (2006.01) |
| ***F41A 9/65*** | (2006.01) |
| ***F41A 9/67*** | (2006.01) |
| ***F41A 9/70*** | (2006.01) |
| ***F41B 11/55*** | (2013.01) |

(52) U.S. Cl.
CPC ... *F41A 9/70* (2013.01); *F41A 9/67* (2013.01); *F41A 9/65* (2013.01); *F41B 11/55* (2013.01)

(58) Field of Classification Search
CPC ..... F41B 11/55; F41A 9/67; F41A 9/65
USPC ..... 124/51.1, 52; 42/49.01, 50
See application file for complete search history.

(56) References Cited

U.S. PATENT DOCUMENTS

| | | | | | |
|---|---|---|---|---|---|
| 2,066,361 | A * | 1/1937 | Nomar | 42/49.01 |
| 2,394,606 | A * | 2/1946 | Gazda | 89/34 |
| 2,569,995 | A * | 10/1951 | Kapsa | 124/53 |
| 3,447,527 | A * | 6/1969 | Jiri et al. | 124/52 |
| 4,430,821 | A * | 2/1984 | Vincent | 42/50 |
| 4,881,621 | A * | 11/1989 | Ishida | 185/39 |
| 5,520,171 | A * | 5/1996 | David | 124/51.1 |
| 6,694,658 | B1 * | 2/2004 | Marsac | 42/54 |
| 6,736,125 | B2 * | 5/2004 | Petrosyan et al. | 124/51.1 |
| 6,796,300 | B2 * | 9/2004 | Petrosyan et al. | 124/48 |
| 7,765,997 | B2 * | 8/2010 | Klockener et al. | 124/48 |
| 8,468,730 | B2 * | 6/2013 | Faifer et al. | 42/50 |
| 2003/0056777 | A1 * | 3/2003 | Liang | 124/52 |
| 2007/0175464 | A1 * | 8/2007 | Cherepanov | 124/51.1 |
| 2008/0029076 | A1 * | 2/2008 | Liang | 124/51.1 |
| 2011/0030667 | A1 * | 2/2011 | Lin | 124/52 |
| 2011/0041823 | A1 * | 2/2011 | Victor et al. | 124/48 |
| 2011/0056468 | A1 * | 3/2011 | Cho | 124/45 |
| 2011/0167695 | A1 * | 7/2011 | Faifer et al. | 42/50 |
| 2011/0253119 | A1 * | 10/2011 | Cho | 124/41.1 |
| 2012/0160225 | A1 * | 6/2012 | Cho | 124/52 |
| 2014/0060509 | A1 * | 3/2014 | Tseng | 124/40 |

* cited by examiner

*Primary Examiner* — Melba Bumgarner
*Assistant Examiner* — Alexander Niconovich

(57) ABSTRACT

A magazine for an air gun is provided with first and second shells; an internal passage; a rotatable shaft including a lengthwise groove on a surface, and a transverse slot on the surface communicating with the groove; a pulley rotatably put on the shaft and having both ends rotatably secured to the first and second shells respectively; a ratchet mechanism mounted on the pulley; a pin inserted into the pulley to dispose in one end of the groove; a line having one end wound on the pulley, the line extending through the passage to have an other end engaged with a projectile support in the passage; a spring put on the line and biased between the pulley and the projectile support; and a spring biased knob disposed on an outer surface of the first shell and secured to the shaft.

1 Claim, 6 Drawing Sheets

AIR GUN MAGAZINE WITH RATCHET LOADING MECHANISM

BACKGROUND OF THE INVENTION

1. Field of the Invention

The invention relates to air guns and more particularly to a magazine for an air gun, the magazine having a ratchet loading mechanism.

2. Description of Related Art

There is a conventional magazine for an air gun having opposite first and second ends, the magazine comprising a rotary clip attachment adjacent to a selected one of the first and second ends, and a rotary clip rotatably connected to the rotary clip attachment and including a rotary clip cylindrical end surface. The rotary clip attachment has a wall defining a rotary clip wall surface opposing the rotary clip cylindrical end surface. Thus, at least a portion of the rotary clip wall surface gradually moves away from the rotary clip cylindrical end surface in an inclined manner and in a direction of the selected one of the first and second ends.

Notwithstanding the prior art, the invention is neither taught nor rendered obvious thereby.

SUMMARY OF THE INVENTION

It is therefore one object of the invention to provide a magazine for an air gun comprising a first shell; a second shell releasably secured to the first shell; a passage formed by both the first and second shells; a rotatable shaft including a lengthwise groove on a surface, a transverse slot on the surface, the transverse slot connecting to and communicating with the lengthwise groove, and two opposite mating members on one end; a pulley rotatably put on the rotatable shaft and having both ends rotatably secured to the first shell and the second shell respectively; a ratchet mechanism mounted on the pulley; a pin inserted into the pulley to dispose in one end of the lengthwise groove; a line having one end wound on the pulley, the line extending through the passage to have an other end engaged with a projectile support in the passage; a biasing member put on the line and biased between the pulley and the projectile support; and a spring biased knob disposed on an outer surface of the first shell and including two opposite corresponding mating members engaged with the mating members, the spring biased knob being releasably secured to the rotatable shaft; wherein a pressing of the spring biased knob until being stopped; a clockwise turning of the spring biased knob until stopped disposes the pin at an other end of the transverse slot; a continuous, clockwise rotation of the spring biased knob winds the line around the pulley and compresses the biasing member until being stopped; a counterclockwise rotation of the spring biased knob until being stopped; and a release of the spring biased knob until being stopped disposes the pin at one end of the lengthwise groove so as to create a space in the passage for projectile loading.

The above and other objects, features and advantages of the invention will become apparent from the following detailed description taken with the accompanying drawings.

DETAILED DESCRIPTION OF THE INVENTION

Figure 1:
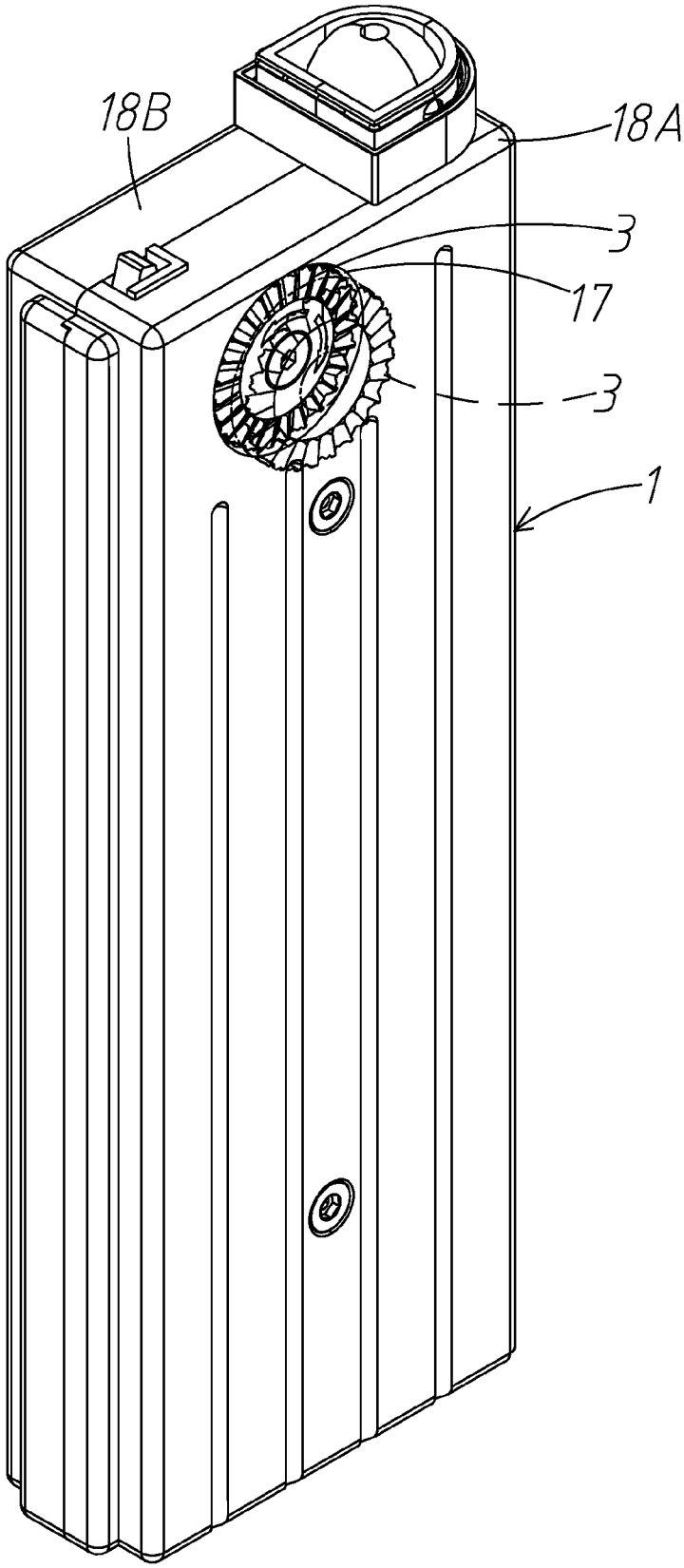
FIG. 1 is a perspective view of a magazine for an air gun according to the invention.
Figure 2:
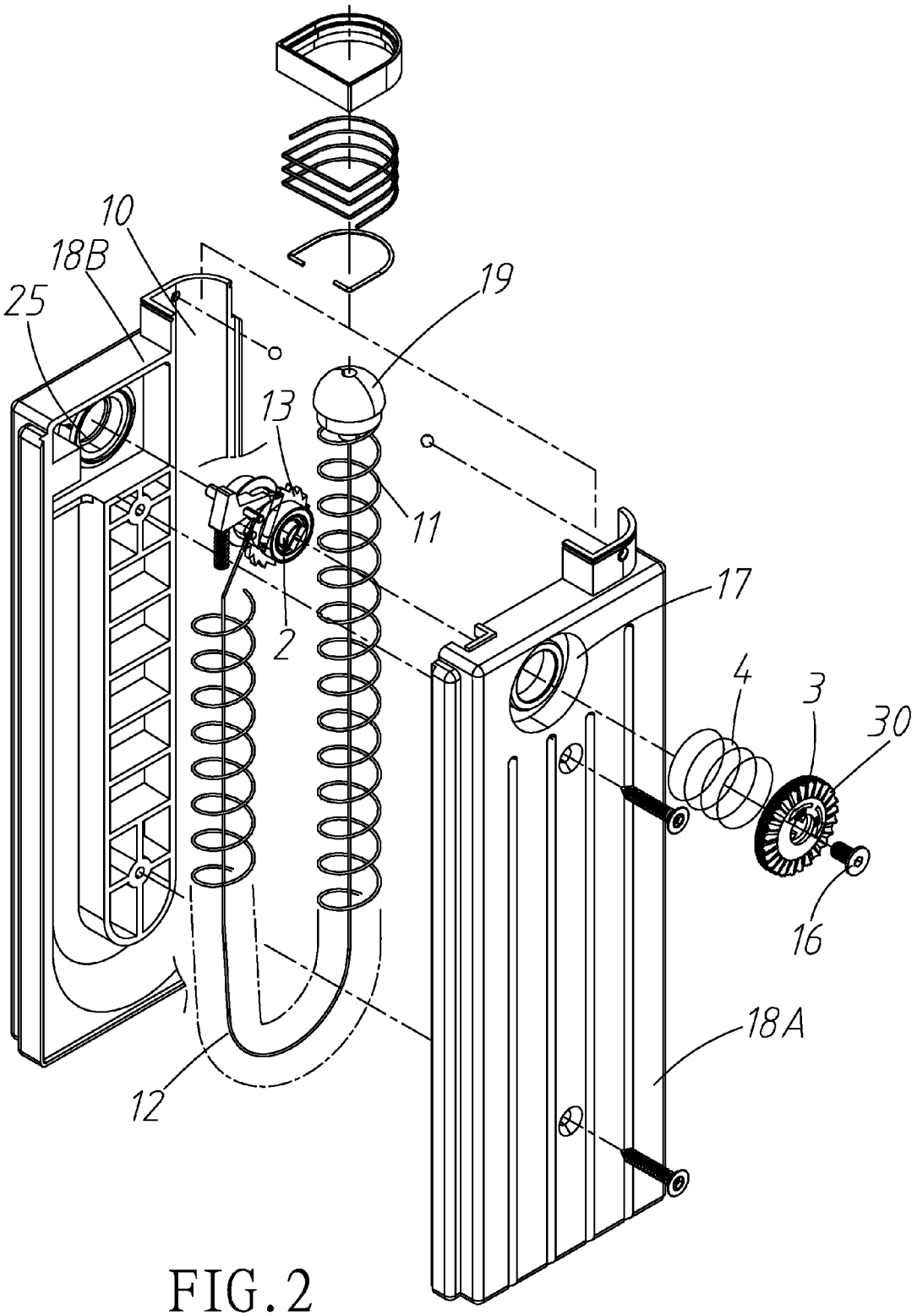
FIG. 2 is an exploded view of FIG. 1.
Figure 3:
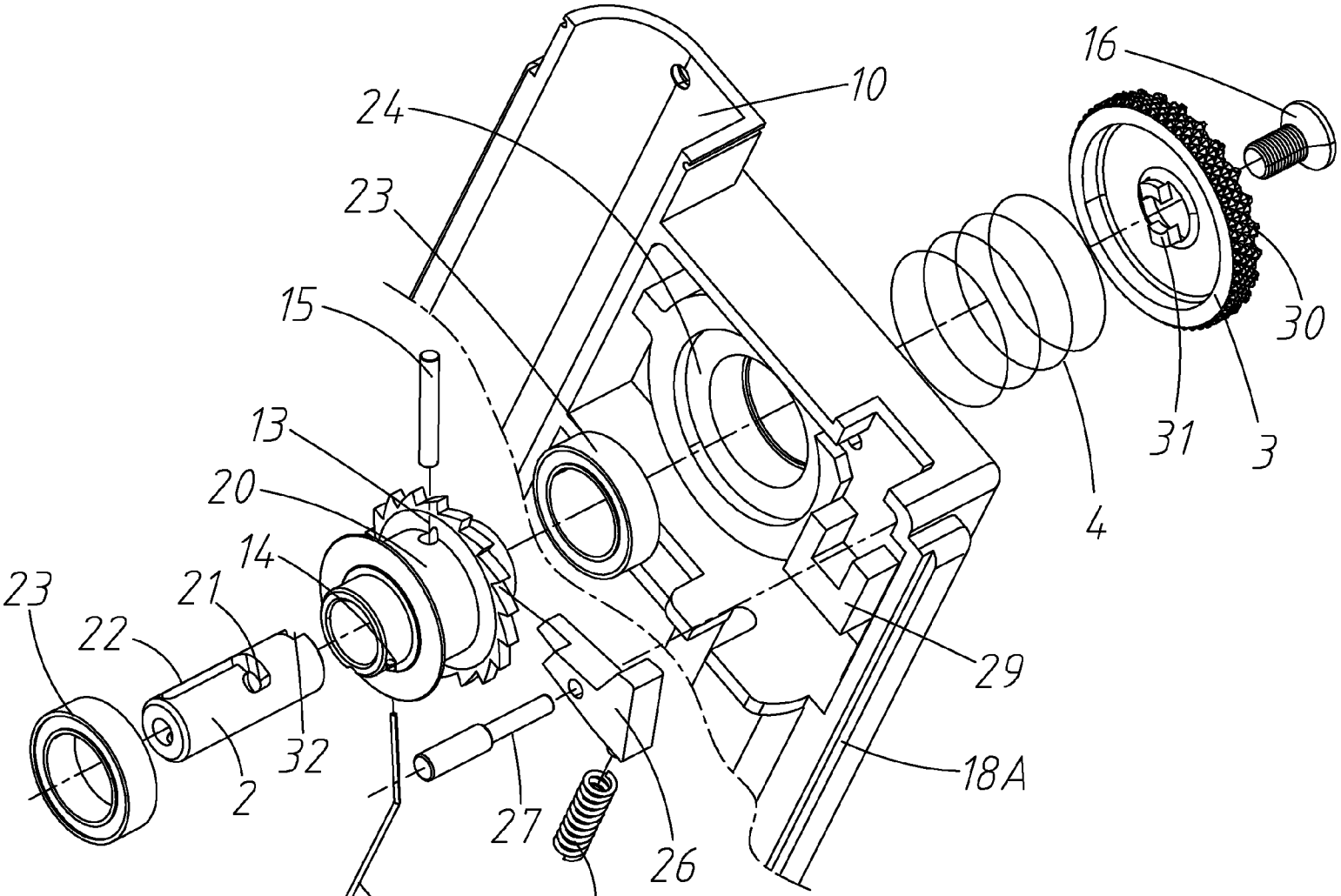
FIG. 3 is an enlarged view of a portion of FIG. 2.
Figure 4:
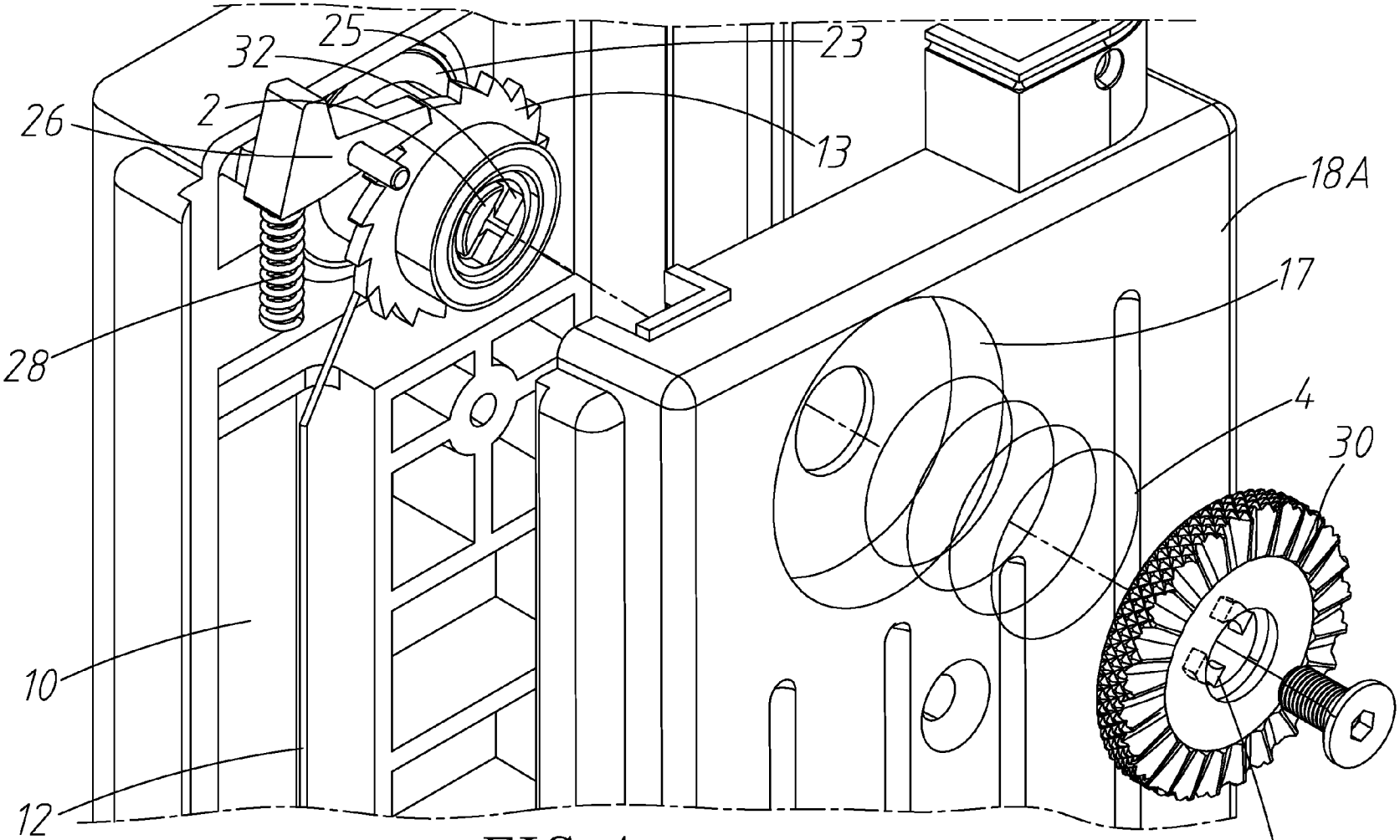
FIG. 4 is an exploded perspective view of FIG. 3.

Referring to FIGS. 1 to 8, a magazine 1, consisting of a first shell 18A and a second shell 18B threadedly secured together, for an air gun (e.g., compressed-air toy gun) in accordance with the invention comprises the following components as discussed in detail below.

A U-shaped passage 10 is provided. A curved line 12 has one end terminated at a pulley 20 of a cylindrical rotatable shaft 2 and the other end engaged with a bottom of a projectile support 19. In detail, one end of the line 12 passes through a hole 14 through a cylindrical, hollow pulley 20 and wound thereon. Further, a gear 13 is mounted on one end of the pulley 20. Furthermore, the gear 13 cooperates with a pawl 26. A helical spring 11 is put on the line 12 and biased between the rotatable shaft 2 and the support 19. Two bearings 23 are provided in which one bearing 23 is disposed in a stepped-diameter passageway 24 through the first shell 18A and the other bearing 23 is disposed in a stepped-diameter passageway 25 in the second shell 18B. One end of the pulley 20 is rotatably disposed in one bearing 23 and the other end thereof is rotatably disposed in the other bearing 23. A pivot pin 27 has one end fastened in the first shell 18A and the other end fastened in the second shell 18B. The pivot pin 27 is loosely inserted through the pawl 26. A bottom of the pawl 26 is supported by a top of a torsion spring 28 anchored in a spring receptacle 29 formed on an inner surface of the first shell 18A. Thus, the pawl 26 can be pivoted to allow the gear 13 to rotate in only one direction (e.g., clockwise direction). A pin 15 is inserted into the pulley 20 and moveable disposed in a lengthwise groove 22 and a transverse slot 21 both formed on the rotatable shaft 2. Further, the groove 22 and the slot 21 communicate each other and form a 90-degree bent member. The rotatable shaft 2 comprises two opposite recesses 32 on one end surface. The rotatable shaft 2 is rotatably fastened in the pulley 20. A cup-shaped knob 3 comprises two opposite projections 31 on an inner surface complementarily disposed in the recesses 32, and a knurled rim 30. A screw 16 is driven through a central opening of the knob 3 into the rotatable shaft 2 so that the knob 3, the rotatable shaft 2, the pulley 20, and the gear 13 can be co-rotated. A helical spring 4 is biased between the inner surface of the knob 3 and a circular well 17 formed on an outer surface of the first shell 18A. Thus, the knob 3 is resiliently disposed in the well 17. It noted that the pin 15 is moveably disposed in one end of the groove 22 distal the slot 21.

Figure 5:
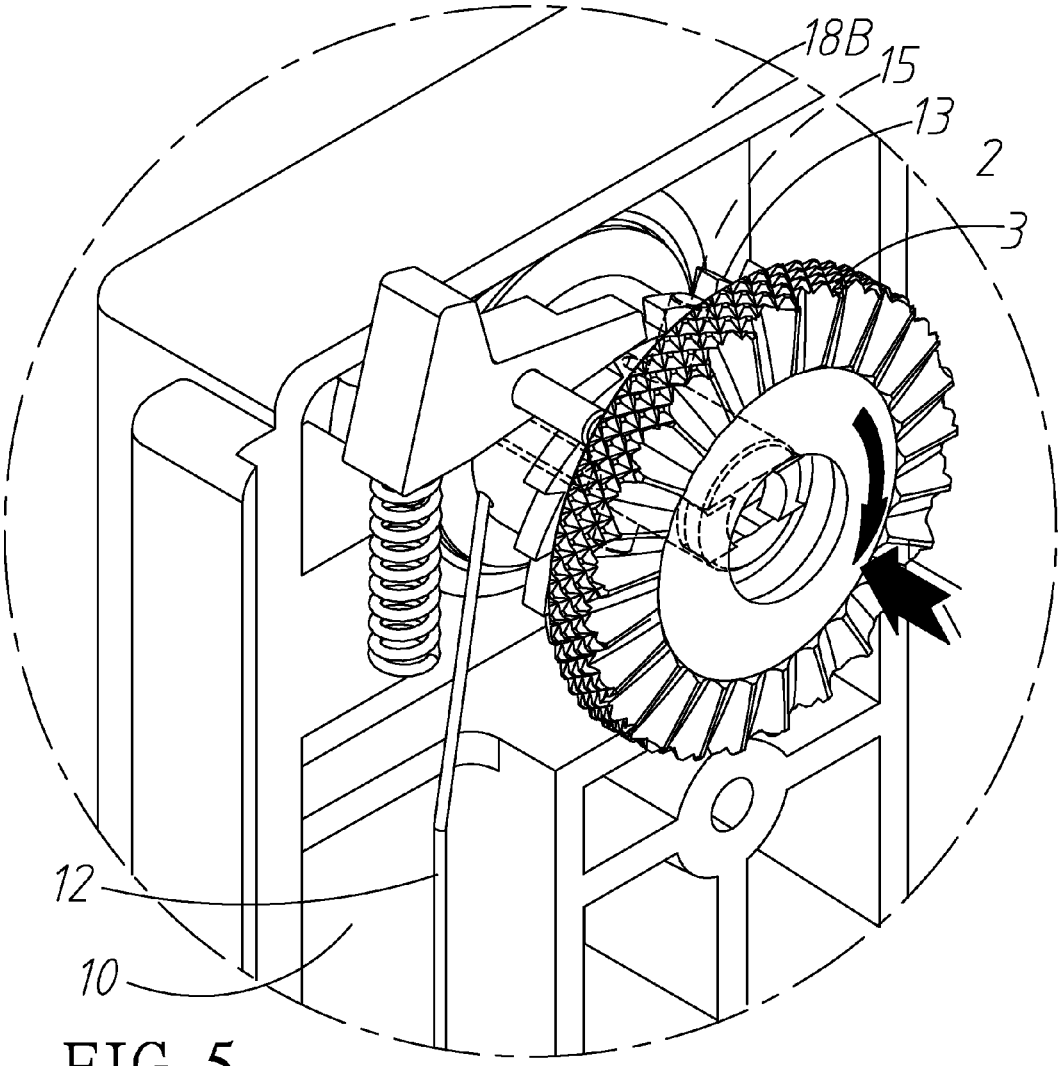
FIG. 5 is a perspective view of the assembled components of FIG. 4 with the first shell removed showing first operations before loading.
Figure 6:
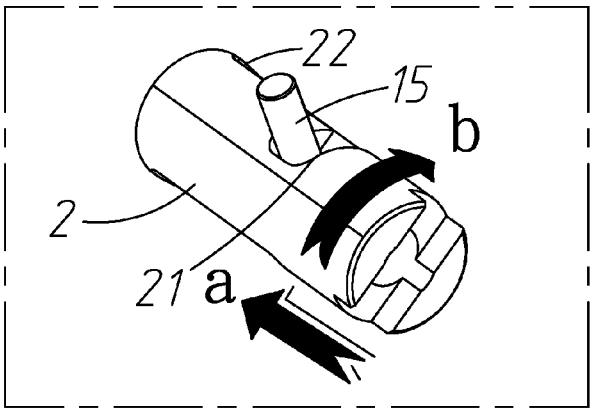
FIG. 6 is a perspective view of the rotatable shaft of FIG. 5.

A projectile loading operation is discussed in detail below. As shown in FIGS. 5 and 6, an individual may press the knob 3 as indicated by arrow a until the pin 15 is stopped (i.e., disposed at the other end of the groove 22 and one end of the slot 21). The individual may further clockwise turn the knob 3 as indicated by arrow b until the pin 15 is stopped (i.e., disposed at the other end of the slot 21). Thereafter, the individual may continuously, clockwise rotate the knob 3 to wind the line 12 around the pulley 20 with the spring 11 being compressed until being stopped. It is noted that the gear 13 is allowed to only rotate clockwise due to the provision of the pawl 26.

Figure 7:
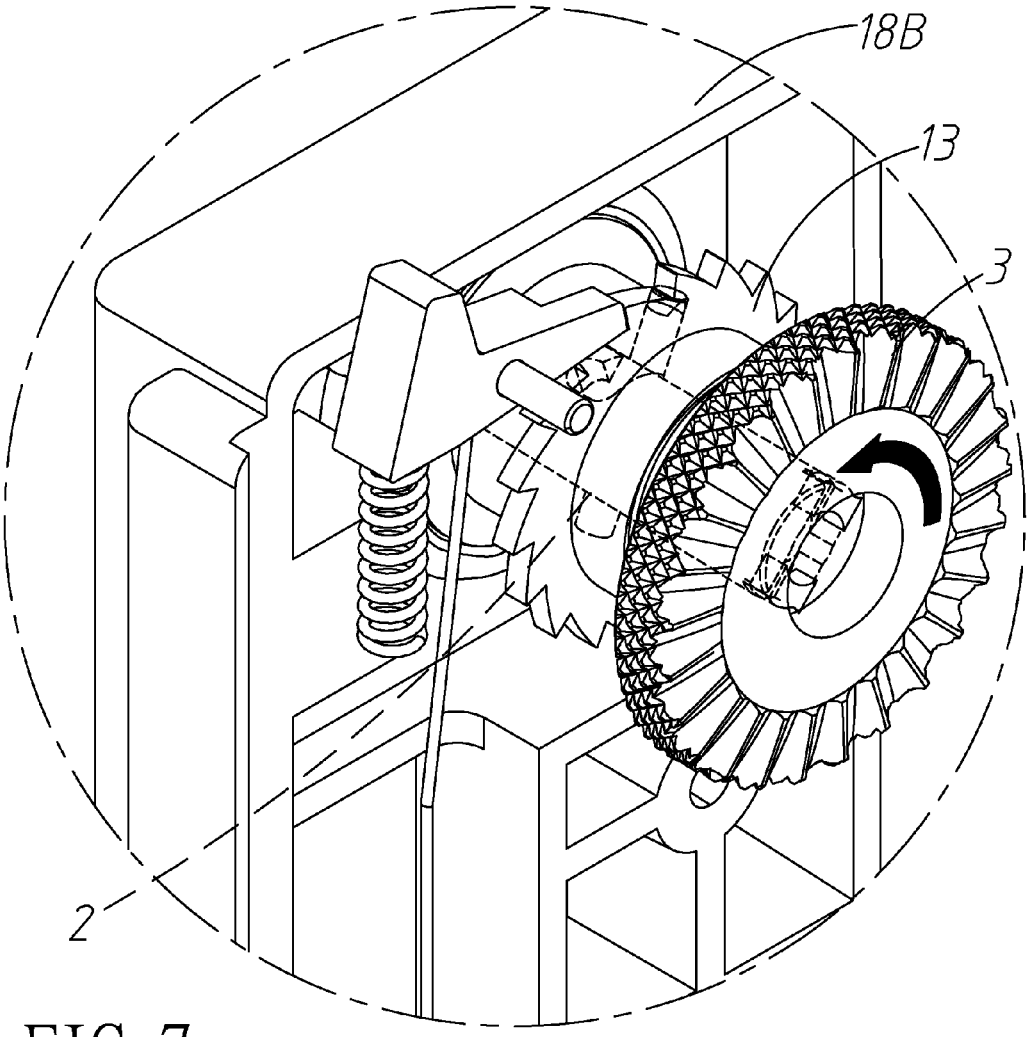
FIG. 7 is a view similar to FIG. 5 showing second operations before loading.
Figure 8:
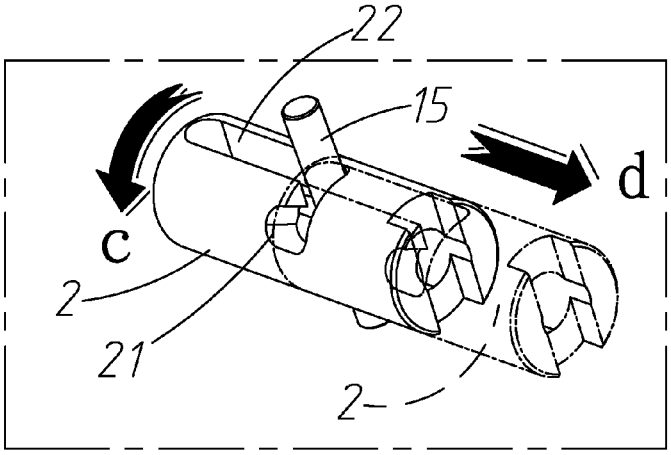
FIG. 8 is a perspective view of the rotatable shaft of FIG. 7.

As shown in FIGS. 7 and 8, the individual may counterclockwise rotate the knob 3 as indicated by arrow c until the pin 15 is stopped (i.e., disposed at the other end of the groove 22 and one end of the slot 21). The individual may further release the knob 3 until being stopped as indicated by arrow d until the pin 15 is stopped (i.e., disposed at one end of the groove 22). Finally, the individual may load a plurality of projectiles into a space between the projectile support 19 and a top opening of the passage 10 for temporary storage. This completes the loading operation.

While the invention has been described in terms of preferred embodiments, those skilled in the art will recognize that the invention can be practiced with modifications within the spirit and scope of the appended claims.

What is claimed is:

1. A magazine for an air gun comprising:

a first shell;

a second shell releasably secured to the first shell;

a passage formed by both the first and second shells;

a rotatable shaft including a lengthwise groove on a surface, a transverse slot on the surface, the transverse slot connecting to and communicating with the lengthwise groove, and two opposite mating members on one end of the rotatable shaft;

a pulley rotatably put on the rotatable shaft and having both ends rotatably secured to the first shell and the second shell respectively;

a ratchet mechanism mounted on the pulley;

a pin inserted into the pulley to dispose in one end of the lengthwise groove;

a line having one end wound on the pulley, the line extending through the passage to have an other end engaged with a projectile support in the passage;

a biasing member put on the line and biased between the pulley and the projectile support; and a spring biased knob disposed on an outer surface of the first shell and including two opposite corresponding mating members engaged with the mating members, the spring biased knob being releasably secured to the rotatable shaft;

wherein a pressing of the spring biased knob until being stopped and a subsequent, clockwise turning of the spring biased knob until being stopped dispose the pin at an other end of the transverse slot; a continuous, clockwise rotation of the spring biased knob rotates both the pulley and the ratchet mechanism to wind the line around the pulley and compresses the biasing member until being stopped; a counterclockwise rotation of the spring biased knob until being stopped; and a release of the spring biased knob until being stopped disposes the pin at one end of the lengthwise groove so as to create a space in the passage for projectile loading.

* * * * *